US005201850A

United States Patent [19]

Lenhardt et al.

[11] Patent Number: 5,201,850

[45] Date of Patent: Apr. 13, 1993

[54] ROTOR TIP SHROUD DAMPER INCLUDING DAMPER WIRES

[75] Inventors: Christopher H. Lenhardt; Carl Grant; Chellappa Balan, all of Cincinnati, Ohio

[73] Assignee: General Electric Company, Cincinnati, Ohio

[21] Appl. No.: 655,701

[22] Filed: Feb. 15, 1991

[51] Int. Cl.[5] ..... F01D 5/10

[52] U.S. Cl. ..... 416/190; 416/191; 416/192; 416/195; 416/500

[58] Field of Search ..... 416/190, 191, 192, 194, 416/195, 221, 500

[56] References Cited

U.S. PATENT DOCUMENTS

| | | | |
|---|---|---|---|
| 3,034,762 | 5/1962 | Fanti et al. . | |
| 3,377,050 | 4/1968 | Guy . | |
| 3,649,133 | 3/1972 | Wagner | 416/194 |
| 3,752,599 | 8/1973 | Pace | 416/190 |
| 4,076,455 | 2/1978 | Stargardter | 416/191 |
| 4,191,508 | 3/1980 | Kuroda et al. | 416/196 R |
| 4,699,569 | 10/1987 | Gloor | 416/191 |
| 4,734,010 | 3/1988 | Battig | 416/196 R |
| 4,767,273 | 8/1988 | Partington | 416/191 |
| 4,776,764 | 10/1988 | Ortolano | 416/196 R |
| 4,815,938 | 3/1989 | Brown | 416/191 |
| 4,822,248 | 4/1989 | Wertz et al. | 416/192 |
| 4,840,539 | 6/1989 | Bourcier et al. | 416/195 |
| 4,884,951 | 12/1989 | Meylan et al. | 416/191 |
| 4,936,749 | 6/1990 | Arrao et al. | 416/193 A |
| 5,037,273 | 8/1991 | Krueger et al. | 416/191 |

FOREIGN PATENT DOCUMENTS

| | | | |
|---|---|---|---|
| 0873151 | 6/1971 | Canada | 416/190 |
| 0219140 | 4/1987 | European Pat. Off. | 416/190 |
| 1300577 | 8/1969 | Fed. Rep. of Germany | 416/191 |
| 2606891 | 9/1976 | Fed. Rep. of Germany | 416/221 |
| 1519898 | 2/1967 | France | 416/190 |
| 693041 | 11/1979 | U.S.S.R. . | |
| 0267405 | 3/1927 | United Kingdom | 416/195 |
| 1287223 | 8/1972 | United Kingdom | 416/191 |

*Primary Examiner*—Edward K. Look
*Assistant Examiner*—Christopher M. Verdier
*Attorney, Agent, or Firm*—Jerome C. Squillaro

[57] ABSTRACT

A rotor includes a disc having a plurality of blades extending therefrom. The blades include tip shrouds, each having first and second axial ends, and first and second circumferential faces. The first and second faces of adjacent tip shrouds are spaced from each other to define gaps therebetween. The first and second ends each include U-shaped slots, each having an arcuate damper wire disposed therein. The slots are aligned generally parallel to an axial centerline axis of the rotor for allowing ease of manufacture and assembly while providing effective frictional damping by the damper wires urged by centrifugal force against the slots.

8 Claims, 2 Drawing Sheets

ROTOR TIP SHROUD DAMPER INCLUDING DAMPER WIRES

TECHNICAL FIELD

The present invention relates generally to gas turbine engines, and, more specifically, to vibration damping of rotors therein.

BACKGROUND ART

Conventional gas turbine engines typically include fan, compressor, and turbine rotors each including a plurality of circumferentially spaced blades extending radially outwardly from a rotor disc. The blades typically have either axial entry or circumferential entry dovetails which are disposed in complementary dovetail slots formed in the perimeter of the rotor disc for securing the blades to the disc.

During operation of the engine, the rotor blades are subject to vibratory excitation forces due to, for example, the rotational speed of the rotor and aerodynamic pressure forces from the fluids channeled over the blades. Where the frequency of excitation is the same as one of the resonant natural frequencies of the blades, undesirable resonance of the blades may occur unless suitable damping is provided. For example, in the dovetail-bladed rotor disc described above, some frictional dampening occurs between the dovetails and the rotor discs. Additional dampening may be obtained by providing conventional dampers near the blade roots, the blade mid-spans, or the blade tips. Such conventional dampers may be readily provided since each of the blades is independently manufactured and assembled into the rotor disc.

However, providing effective damping of a gas turbine engine rotor in the form of a blisk presents additional problems. A blisk is an integral bladed-disc assembly wherein the blades are conventionally formed as integral portions of the rotor disc, and are not, therefore, independently manufactured separately from the rotor disc. Nor do the blisk blades have conventional dovetails for being inserted into and removed from the rotor disc. Accordingly, blisks are inherently stiff structures which do not enjoy the type of internal damping which is provided by conventional bladed-disc assemblies. Furthermore, since a blisk is typically manufactured from a single rotor blank with the individual blisk blades being machined therefrom, it is typically not possible to employ conventional dampers therein of the type which are conventionally manufactured for individual dovetailed blades before being assembled to the disc.

OBJECTS OF THE INVENTION

Accordingly, one object of the present invention is to provide a rotor having new and improved blade dampers.

Another object of the present invention is to provide a blisk having dampers which are relatively easily manufacturable.

Another object of the present invention is to provide a blisk having dampers which may be readily assembled and disassembled for damper replacement.

DISCLOSURE OF INVENTION

A rotor includes a disc having a plurality of blades extending therefrom. The blades include tip shrouds, each having first and second axial ends, and first and second circumferential faces. The first and second faces of adjacent tip shrouds are spaced from each other to define gaps therebetween. The first and second ends each include U-shaped slots, each having an arcuate damper wire disposed therein. The slots are aligned generally parallel to an axial centerline axis of the rotor for allowing ease of manufacture and assembly while providing effective frictional damping by the damper wires urged by centrifugal force against the slots.

BRIEF DESCRIPTION OF DRAWINGS

The novel features believed characteristic of the invention are set forth and differentiated in the claims. The invention, in accordance with a preferred and exemplary embodiment, together with further objects and advantages thereof, is more particularly described in the following detailed description taken in conjunction with the accompanying drawing in which:

MODE(S) FOR CARRYING OUT THE INVENTION

Figure 1:
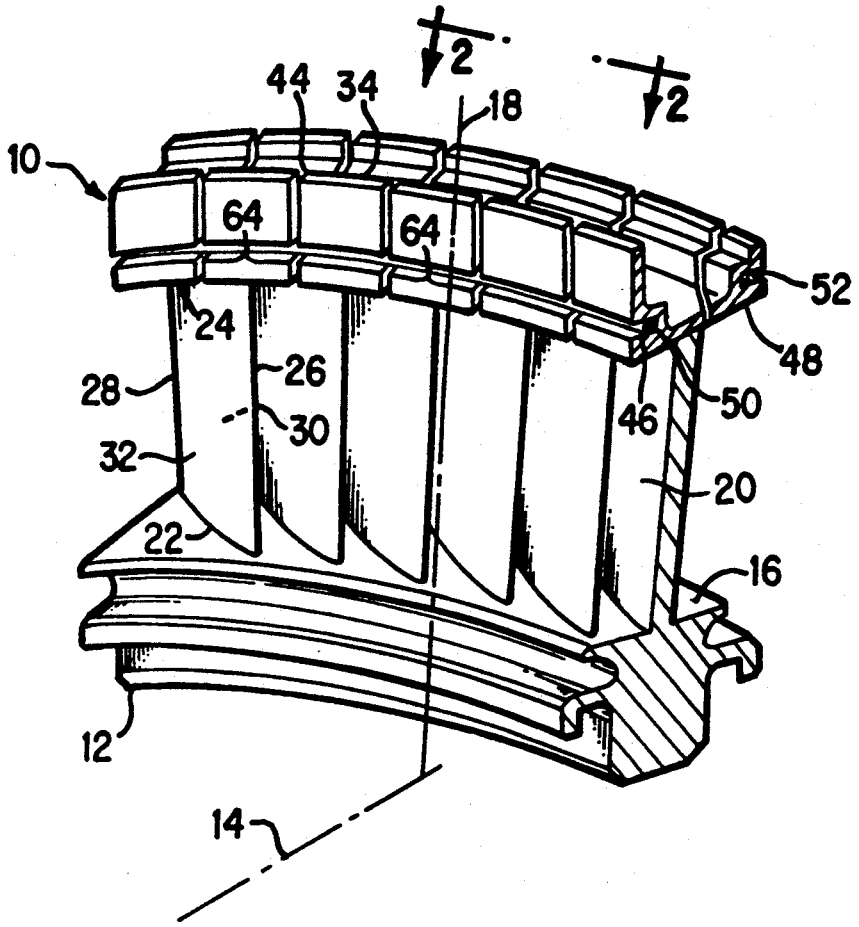
FIG. 1 is a perspective view of a portion of a gas turbine engine rotor blisk including integral tip shrouds having damper wires therein in accordance with one embodiment of the present invention.

Illustrated in FIG. 1 is an exemplary gas turbine engine rotor 10, in the form of a blisk, including an annular disc 12 having an axial centerline axis 14. The disc 12 includes a perimeter 16 from which extend radially outwardly and generally parallel to respective radial axes 18 a plurality of circumferentially spaced blades 20 which are conventionally formed integrally with the disc 12.

Each of the blades 20 is conventional and includes a root 22 joined to the disc perimeter 16, a tip 24, a leading edge 26, a trailing edge 28, a pressure or concave surface 30, and a suction or convex surface 32.

In accordance with a preferred embodiment of the present invention, the blisk 10 further includes a plurality of circumferentially spaced tip shrouds 34 joined to respective ones of the blades 20 at the tips 24 thereof. The tip shrouds 34 are preferably integral with the blade tips 24.

Figure 2:
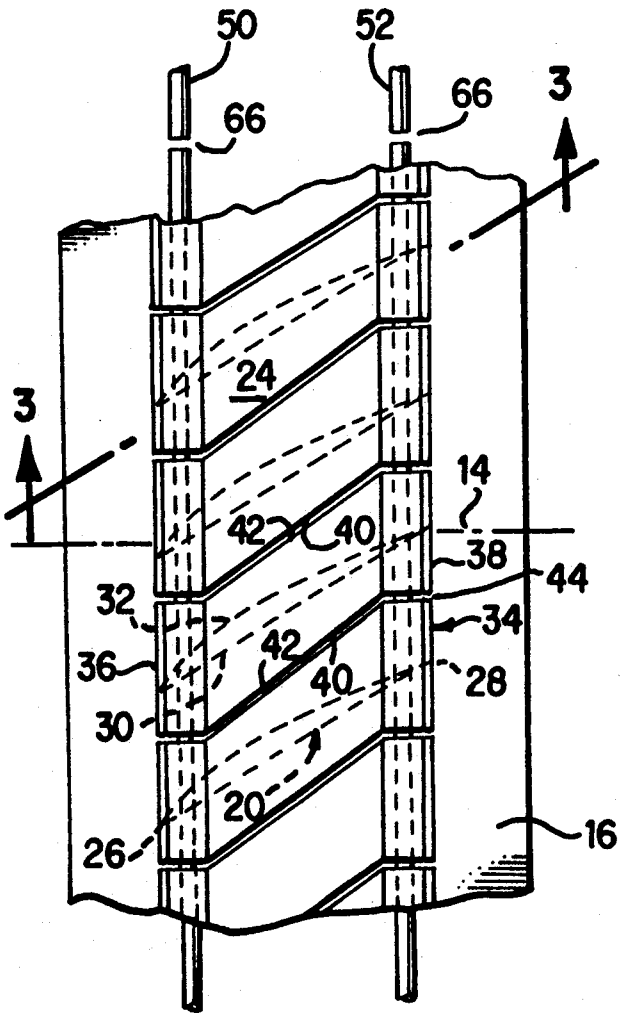
FIG. 2 is a top view of a portion of the blisk and tip shrouds illustrated in FIG. 1 taken along line 2—2.

As illustrated in FIG. 2, each of the tip shrouds 34 includes an upstream facing first axial end 36 disposed radially over the blade leading edge 26, and a downstream facing second axial end 38 disposed radially over the blade trailing edge 28. The tip shroud 34 further includes a first circumferential face 40 extending between the first and second axial ends 36 and 38 over the blade concave surface 30, and a second circumferential face 42 extending between the first and second axial ends 36 and 38 over the blade convex surface 32. Respective ones of the first and second circumferential faces 40 and 42 of adjacent tip shrouds 34 are preferably circumferentially spaced from each other to define an axially extending gap 44. The first and second circumferential faces 40 and 42 are disposed at least in part parallel to each other and diagonally relative to the shroud first and second axial ends 36 and 38 for being aligned generally with the blade tip 24. In this way, each tip shroud 34 extends generally equally circumferentially from the concave and convex surfaces 30 and 32 toward the adjacent tip shrouds 34.

The tip shrouds 34 add a predetermined amount of weight to the blade 20 for tuning the natural frequencies thereof out of the operating range of the blisk 10 for reducing, if not eliminating, resonance of the blisk 10 during engine operation. However, any resonance or vibration of the blisk 10, including the blades 20 extending from the disc 12, may be damped in part by contact between adjacent ones of the first and second circumferential faces 40 and 42. The gap 44 has a predetermined magnitude, for example 5.00 mils (0.127 mm), to allow some vibratory movement of the individual blades 20 which is limited by contact of adjacent faces 40 and 42.

Figure 4:
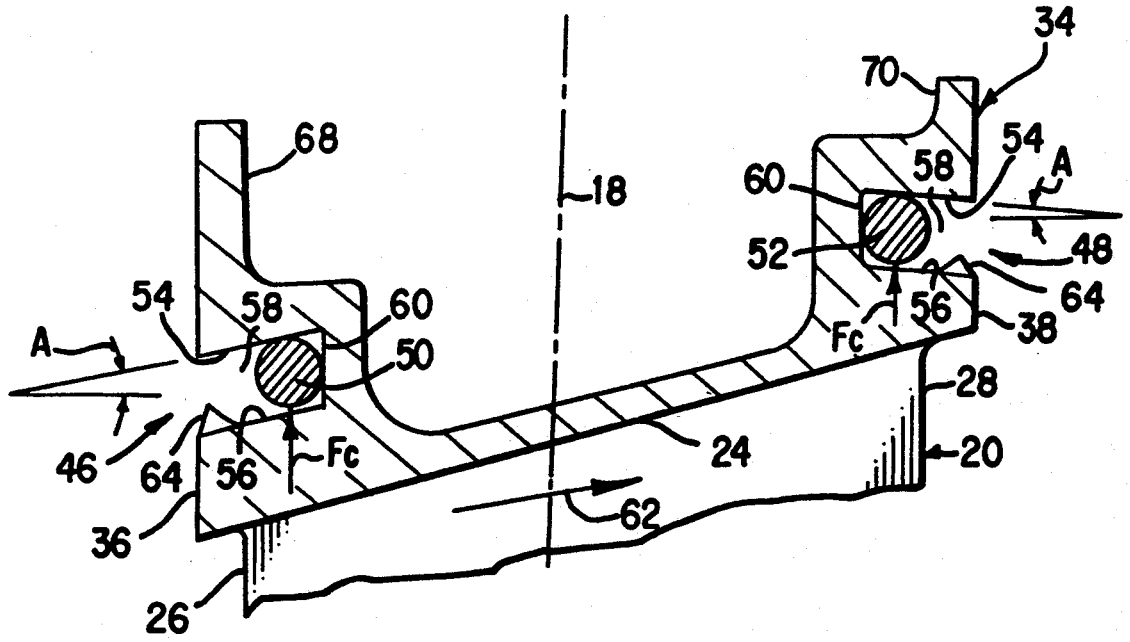
FIG. 4 is an enlarged transverse, radially extending sectional view of the tip shroud and blade tip illustrated in FIG. 3.
Figure 3:
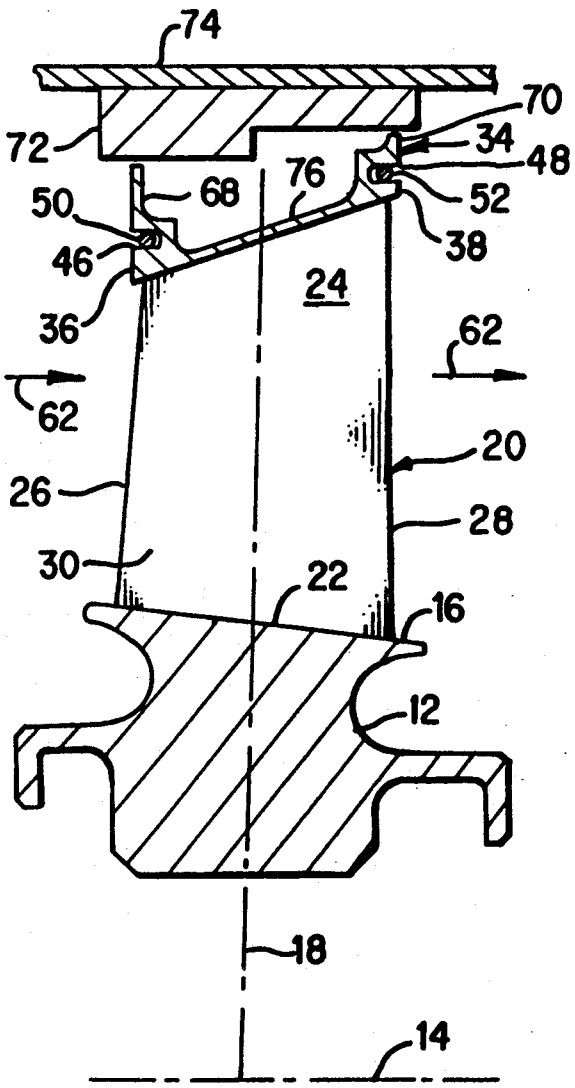
FIG. 3 is a transverse, radially extending sectional view of the blisk illustrated in FIG. 2 taken along line 3—3.

As illustrated in more particularity in FIGS. 3 and 4, the first and second axial ends 36 and 38 of the tip shroud 34 include U-shaped first and second slots 46 and 48, respectively, disposed therein. The slots 46 and 48 are arcuate in axial planes and extend circumferentially relative to the centerline axis 14, as shown in FIG. 1, and are radially aligned with respective slots 46, 48 of adjacent shrouds 34 to collectively form complete 360° slots. In radially extending transverse planes, the slots 46, 48 extend generally parallel to the axial centerline axis 14.

First and second arcuate damper wires 50 and 52 are disposed in the first and second slots 46 and 48, respectively, for damping vibration of the blisk 10, including the blades 20, by friction between the wires 50, 52 and the slots 46, 48 generated by centrifugal force.

More specifically, and referring to FIG. 4, the first and second slots 46 and 48 are substantially identical to each other except that they face in opposite axial directions. Each of the first and second slots 46 and 48 includes an outer surface 54 which is arcuate around the centerline axis 14; a radially inner surface 56 which is also arcuate about the centerline axis 14; an axially facing entrance 58 defined between first ends of the outer and inner surfaces 54 and 56; and a base 60 joining second ends of the outer and inner surfaces 54 and 56. The entrance 58 of the first slot 46 faces in the upstream direction relative to the direction of fluid flow designated 62, and the entrance 58 of the second slot 48 faces in the downstream direction. In the exemplary embodiment illustrated in the Figures, the blisk 10 is a turbine blisk, and the fluid flow 62 is combustion gas from a combustor (not shown) disposed upstream therefrom which combustion gas 62 flows downstream between the blades 20 to an additional turbine stage (not shown).

The first and second damper wires 50 and 52 are predeterminedly sized for loosely fitting in the first and second slots 46 and 48. The outer diameters of the wires 50 and 52 are preferably suitably less than the radial widths of the slots 46 and 48 so that the wires 50 and 52 are free to move therein without restriction. FIG. 4 illustrates the blisk 10 at operating speed wherein centrifugal force, shown as arrows and designated $F_c$, acts on the damper wires 50 and 52 and urges them against the outer surfaces 54 for creating frictional damping when the blades 20 vibrate during operation. In a preferred embodiment of the present invention, the slots 46 and 48, including the outer and inner surfaces 54, 56, are axially straight and inclined at an acute angle A, of about 5° for example, relative to the axial centerline axis 14 with the bases 60 being disposed in part radially outwardly relative to the respective entrances 58. And, the wires 50 and 52 are preferably annular in transverse section. In this way the centrifugal force $F_c$ acts on the wires 50 and 52 to urge them additionally against the bases 60, as well as the outer surfaces 54, for providing increased contact for increasing frictional damping, in addition to ensuring that the damper wires 50 and 52 are urged by centrifugal force into the slots 46 and 48 and retained therein.

As illustrated in FIGS. 1 and 4, each of the slots 46 and 48 preferably includes a plurality of circumferentially spaced stakes 64 disposed at the entrances 58 for retaining the damper wires in the slots 46 and 48 when the blisk 10 is stationary. The stakes 64 may simply be peened portions of the slot inner surfaces 56 which partially close the entrances 58 for preventing the damper wires 50 and 52 from leaving the slots 46 and 48.

Each of the damper wires 50 and 52 is preferably annular, also relative to the centerline axis 14, and extends substantially 360°. Each wire 50, 52 preferably includes only a single interrupting axial gap 66 through its circumference, as illustrated in FIG. 2, for allowing unrestricted radial expansion of the wires 50 and 52. In alternate embodiments of the invention, each of the wires 50 and 52 could include a plurality of circumferentially spaced arcuate segments with a correspondingly adequate number of stakes 64 to ensure the retention thereof in the slots 46 and 48.

Referring again to FIG. 4, the first slot 46 is disposed generally radially outwardly of the leading edge 26, and the second slot 48 is disposed generally radially outwardly of the trailing edge 28. In this way, the distance between the two damper wires 50 and 52 is maximized relative to the axial extent of the blades 20 for providing enhanced frictional damping of the entire blisk 10.

Furthermore, by positioning the slots 46 and 48 over the blade leading and trailing edges 26 and 28, and by facing the entrances 58 in the upstream and downstream directions, respectively, effective damping structure may be relatively easily provided in the tip shrouds 34 of the blisk 10. Since the rotor 10 in the preferred embodiment of the present invention is a blisk having integral blades 20 and integral tip shrouds 34, conventional damping means which require manufacture on individual blades prior to assembly to a disc cannot be provided therein. For example, since the blade root 22 is formed integrally with the disc perimeter 16, no dovetail exists in which suitable conventional damping means may be located. Conventional mid-span blade supports and dampers are not desirable since they would interfere with the fluid flow 62, possibly provide increased blade stress, and since they are typically formed on individual blades separately mounted in conventional manufacturing machines. And, since the tip shrouds 34 are also formed integrally with the blades 20 and collectively form an annular shroud surrounding the blades 20, conventional tip shroud dampers may not be practically formed therein.

However, the present invention allows the integral tip shrouds 34 to be readily machined for accepting the damper wires 50 and 52 since the slots 46 and 48 extend generally parallel to the centerline axis 14 and the entrances 58 face in axial directions. Accordingly, conventional machining may be used for readily machining out the slots 46 and 48 from the first and second ends 36 and 38 of the tip shrouds 34. The damper wires 50 and 52 may then be inserted into the slots 46 and 48 whether as individual split rings, or in the form of a plurality of arcuate segments. The stakes 64 may then be formed on the inner surfaces 56, or alternatively on the outer surfaces 54, for retaining the damper wires 50 and 52 in the slots 46 and 48.

In accordance with another feature of the present invention, the first and second axial ends 36 and 38, including the respective slots and damper wires, may additionally include first and second seal flanges 68 and 70, respectively, as illustrated in FIG. 3, which extend radially outwardly therefrom. The seal flanges 68 and 70 are disposed closely adjacent to a conventional annular stator shroud 72 conventionally joined to a casing 74 and circumferentially around the blisk 10 for forming fluid seals therewith. By combining the seal flanges 68 and 70 with the first and second axial ends 36 and 38, including the first and second slots 46 and 48, respectively, the structural rigidity of the tip shroud 34 is enhanced, and, stress introduced by the slots 46, 48 and wires 50, 52 is reduced. Furthermore, the center portion 76 of the tip shroud 34 between the first and second axial ends 36 and 38 may remain relatively thin in thickness for reducing or avoiding stress and thermally induced distortion in the tip shroud 34 which might otherwise occur if dampers were disposed therein.

While there has been described herein what is considered to be a preferred embodiment of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention, as defined and differentiated in the following claims.

We claim:

1. A rotor comprising:

a disc having a perimeter and an axial centerline axis;

a plurality of circumferentially spaced blades extending outwardly from said disc perimeter;

a plurality of tip shrouds, each tip shroud being joined to a respective one of said blades and including:

a first axial end having a U-shaped first slot disposed therein and extending generally parallel to said axial centerline axis;

a second axial end having a U-shaped second slot disposed therein and extending generally parallel to said axial centerline axis;

each of said first and second slots including:

a radially outer surface;

a radially inner surface;

an axially facing entrance defined at first ends of said outer and inner surfaces; and a base joining second ends of said outer and inner surfaces;

a first circumferential face extending between said first and second axial ends;

a second circumferential face extending between said first and second axial ends; and respective ones of said first and second circumferential faces of adjacent tip shrouds being circumferentially spaced from each other to define an axially extending gap;

first and second arcuate damper wires disposed in said first and second slots, respectively, and having outer diameters less than radial widths of said first and second slots for damping vibration of said rotor by friction between said wires and said slots; and wherein each of said radially outer surfaces of said first and second slots is axially straight and inclined at an acute angle relative to said axial centerline axis so that centrifugal force acting on said damper wires urges said wires against said outer surfaces and said base.

2. A rotor according to claim 1 wherein said first and second slots each includes a plurality of circumferentially spaced stakes disposed at said entrance thereof for retaining said damper wires in said slots.

3. A rotor according to claim 1 wherein each of said blades has a leading edge and a trailing edge and said first slot is disposed generally radially outwardly of said leading edge, and said second slot is disposed generally radially outwardly of said trailing edge.

4. A rotor according to claim 3 wherein said entrance of said first slot faces axially in an upstream direction and said entrance of said second slot faces axially in a downstream direction.

5. A rotor according to claim 1 wherein said rotor is a blisk having said blades formed integrally with said disc.

6. A rotor according to claim 1 wherein each of said damper wires is annular relative to said axial centerline axis and includes only a single axial gap through its circumference for allowing unrestricted radial expansion of said wire.

7. A rotor according to claim 1 wherein said shroud first and second circumferential faces are disposed at least in part parallel to each other and diagonally relative to said shroud first and second axial ends.

8. A rotor according to claim 1 wherein said shroud further includes first and second seal flanges extending radially outwardly from said first and second axial ends, respectively, for forming fluid seals with an annular stator shroud disposable circumferentially around said rotor.

* * * * *